US009432767B2

(12) United States Patent
Hata et al.

(10) Patent No.: US 9,432,767 B2
(45) Date of Patent: Aug. 30, 2016

(54) HEADPHONE WITH MICROPHONES THAT PROCESSES EXTERNAL SOUND PICKUP BY THE MICROPHONES AND INPUTS EXTERNAL SOURCE SOUND SIGNAL

(75) Inventors: Toshiyuki Hata, Hamamatsu (JP); Toshiaki Ishibashi, Fukuroi (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 761 days.

(21) Appl. No.: 13/636,407

(22) PCT Filed: Mar. 22, 2011

(86) PCT No.: PCT/JP2011/056864

§ 371 (c)(1),
(2), (4) Date: Sep. 21, 2012

(87) PCT Pub. No.: WO2011/118595

PCT Pub. Date: Sep. 29, 2011

(65) Prior Publication Data

US 2013/0003983 A1 Jan. 3, 2013

(30) Foreign Application Priority Data

Mar. 23, 2010 (JP) ..... 2010-065526

(51) Int. Cl.
*G10K 11/16* (2006.01)
*H04R 3/00* (2006.01)
(Continued)

(52) U.S. Cl.
CPC ..... *H04R 3/005* (2013.01); *G10K 11/1786* (2013.01); *G10K 2210/1081* (2013.01);
(Continued)

(58) Field of Classification Search
CPC ..... H04R 1/10; H04R 1/1083; H04R 5/033; G10K 11/16; G10K 2210/1083; G10K 2210/108
USPC ..... 381/74, 71.6, 380; 128/866; 174/152 G
See application file for complete search history.

(56) References Cited

U.S. PATENT DOCUMENTS 4,132,861 A 1/1979 Frieder, Jr. et al.
2003/0118197 A1 6/2003 Nagayasu et al.
(Continued)

FOREIGN PATENT DOCUMENTS

JP 07-095681 A 4/1995
JP 08-023594 A 1/1996
(Continued)

OTHER PUBLICATIONS

Japanese Office Action cited in Japanese counterpart application No. JP2010-065526 dated Oct. 4, 2013. English translation provided.
(Continued)

*Primary Examiner* — Simon Sing
(74) *Attorney, Agent, or Firm* — Rossi, Kimms & McDowell LLP

(57) ABSTRACT

A headphone includes: a pair of earphone units each of which includes a speaker and a plurality of microphones which are arranged at a back side of the speaker in a given pattern and through which external sounds are picked up; a sound pickup signal generator configured to generate a plurality of sound pickup signals, each of which has a given directivity, by using a plurality of signals outputted from the plurality of microphones; an external source sound input section through which an external source sound signal from an external source is inputted; and a sound emission signal generator configured to generate sound emission signals, which are to be inputted to the speakers of the earphone units and each of which has a directivity, by using the external source sound signal and the plurality of sound pickup signals.

10 Claims, 6 Drawing Sheets

(51) Int. Cl.

| | |
|---|---|
| ***G10K 11/178*** | (2006.01) |
| *G10L 21/0208* | (2013.01) |
| *H04R 1/10* | (2006.01) |
| *H04R 1/40* | (2006.01) |
| *H04R 5/033* | (2006.01) |

(52) U.S. Cl.

CPC ... *G10K2210/3215* (2013.01); *G10L 21/0208* (2013.01); *H04R 1/10* (2013.01); *H04R 1/406* (2013.01); *H04R 5/033* (2013.01); *H04R 2420/01* (2013.01)

(56) References Cited

U.S. PATENT DOCUMENTS

| | | | | |
|---|---|---|---|---|
| 2005/0232436 | A1 | 10/2005 | Nagayasu et al. | |
| 2007/0015467 | A1 | 1/2007 | Nagayasu et al. | |
| 2008/0187148 | A1* | 8/2008 | Itabashi | G10K 11/178 381/71.6 |
| 2008/0247562 | A1* | 10/2008 | Nagayasu et al. | 381/74 |
| 2009/0034748 | A1 | 2/2009 | Sibbald | |

FOREIGN PATENT DOCUMENTS

| | | | | |
|---|---|---|---|---|
| JP | 08-051686 | A | | 2/1996 |
| JP | 10-304485 | A | | 11/1998 |
| JP | 2001-256771 | A | | 9/2001 |
| JP | 2002-140450 | A | | 5/2002 |
| JP | 2003-198719 | A | | 7/2003 |
| JP | 2005-295175 | A | | 10/2005 |
| JP | 2007-036608 | A | | 2/2007 |
| JP | 2007036608 | A | * | 2/2007 |
| JP | 2007-334968 | A | | 12/2007 |
| JP | 2007-336232 | A | | 12/2007 |
| JP | 2007334968 | A | * | 12/2007 |
| JP | 2007336232 | A | * | 12/2007 |
| JP | 2008-167319 | A | | 7/2008 |
| JP | 2008167319 | A | * | 7/2008 |
| JP | 2009-065456 | A | | 3/2009 |
| JP | 2009-532926 | A | | 9/2009 |
| WO | 01/28195 | A1 | | 4/2001 |

OTHER PUBLICATIONS

International Preliminary Report on Patentability/Written Opinion issued in corresponding International Application No. PCT/JP2011/056864, dated Mar. 22, 2011. English Translation Provided.

ISR issued Apr. 26, 2011 for PCT/JP2011/056864.

Chinese Office Action cited in CN201180015286.5, dated Jul. 3, 2014. English translation provided.

* cited by examiner

HEADPHONE WITH MICROPHONES THAT PROCESSES EXTERNAL SOUND PICKUP BY THE MICROPHONES AND INPUTS EXTERNAL SOURCE SOUND SIGNAL

This application is a U. S. National Phase Application of PCT International Application PCT/JP2011/056864 filed on Mar. 22, 2011 which is based on and claims priority from JP 2010-065526 filed on Mar. 23, 2010 the contents of which is incorporated in its entirety by reference.

TECHNICAL FIELD

The present invention relates to a headphone which has a sound pickup function and through which a picked up sound is emitted in various modes.

BACKGROUND ART

Various headphones having sound pickup functions have been proposed. For example, a headphone disclosed in PTL 1 includes a speaker and a microphone provided in a pair, and the microphone is placed so as to be movable with respect to the speaker. Further, the microphone functions as a microphone for an external sound pickup in a mode in which the microphone, speaker and ear are arranged in this order, and functions as a microphone for noise cancellation in a mode in which the speaker, microphone and ear are arranged in this order.

CITATION LIST

Patent Literature

PTL 1: JP-A-2009-65456

SUMMARY OF INVENTION

Technical Problem

However, in the headphone disclosed in PTL 1, the microphone merely serves to simply pick up an external sound in the mode in which the microphone functions as an external sound pickup microphone. On the other hand, in the mode in which the microphone functions as a noise cancellation microphone, the microphone merely serves to detect a noise included in a sound, which has been emitted from the speaker, until the sound reaches the ear.

Therefore, the above headphone is incapable of appropriately combining a sound inputted to the speaker from a different source with an external sound picked up by the microphone, and thus incapable of allowing the combined sound to be emitted from the speaker.

The present invention has been made in view of the above-described problems, and its object is to provide a headphone capable of processing an external sound picked up by a microphone and a source sound inputted from an external source, so that the external sound and source sound are appropriately combined with each other in accordance with a situation, and capable of emitting the combined sound from an integrally attached speaker in a sound emission mode responsive to the situation.

Solution to Problem

In order to achieve the object, according to the invention, there is provided a headphone comprising: a pair of earphone units each of which includes a speaker and a plurality of microphones which are arranged at a back side of the speaker in a given pattern and through which external sounds are picked up; a sound pickup signal generator configured to generate a plurality of sound pickup signals, each of which has a given directivity, by using a plurality of signals outputted from the plurality of microphones; an external source sound input section through which an external source sound signal from an external source is inputted; and a sound emission signal generator configured to generate sound emission signals, which are to be inputted to the speakers of the earphone units and each of which has a directivity, by using the external source sound signal and the plurality of sound pickup signals.

The headphone may further comprise a sound discriminator configured to make a discrimination between a noise included in the plurality of sound pickup signals and an effective sound, and the sound emission signal generator may generate the sound emission signals based on a result of the discrimination made by the sound discriminator.

The sound emission signal generator may suppress the noise and enhance the effective sound, to generate the sound emission signals.

When the effective sound is inputted, the sound emission signal generator may suppress the external source sound signal and generate sounds, which enhance the effective sound, by using the plurality of sound pickup signals, to generate the sound emission signals.

The sound emission signal generator may include a primary storage for primarily storing the effective sound, and output the sounds, which enhance the effective sound, after a given period of time from a timing of suppressing the external source sound signal.

The headphone may further comprise a non-sound information acquirer configured to acquire non-sound information, and the sound emission signal generator may process the sound emission signals based on the non-sound information.

The non-sound information may include information related to a time.

The non-sound information may include information related to a position.

The headphone may further comprise a non-sound information acquirer configured to acquire non-sound information, and the sound emission signal generator may generate the sound emission signals based on the non-sound information, the effective sound, and the external source sound signal.

The sound emission signal generator may perform frequency characteristic processing on the sound emission signals.

DESCRIPTION OF EMBODIMENTS

Figure 1:
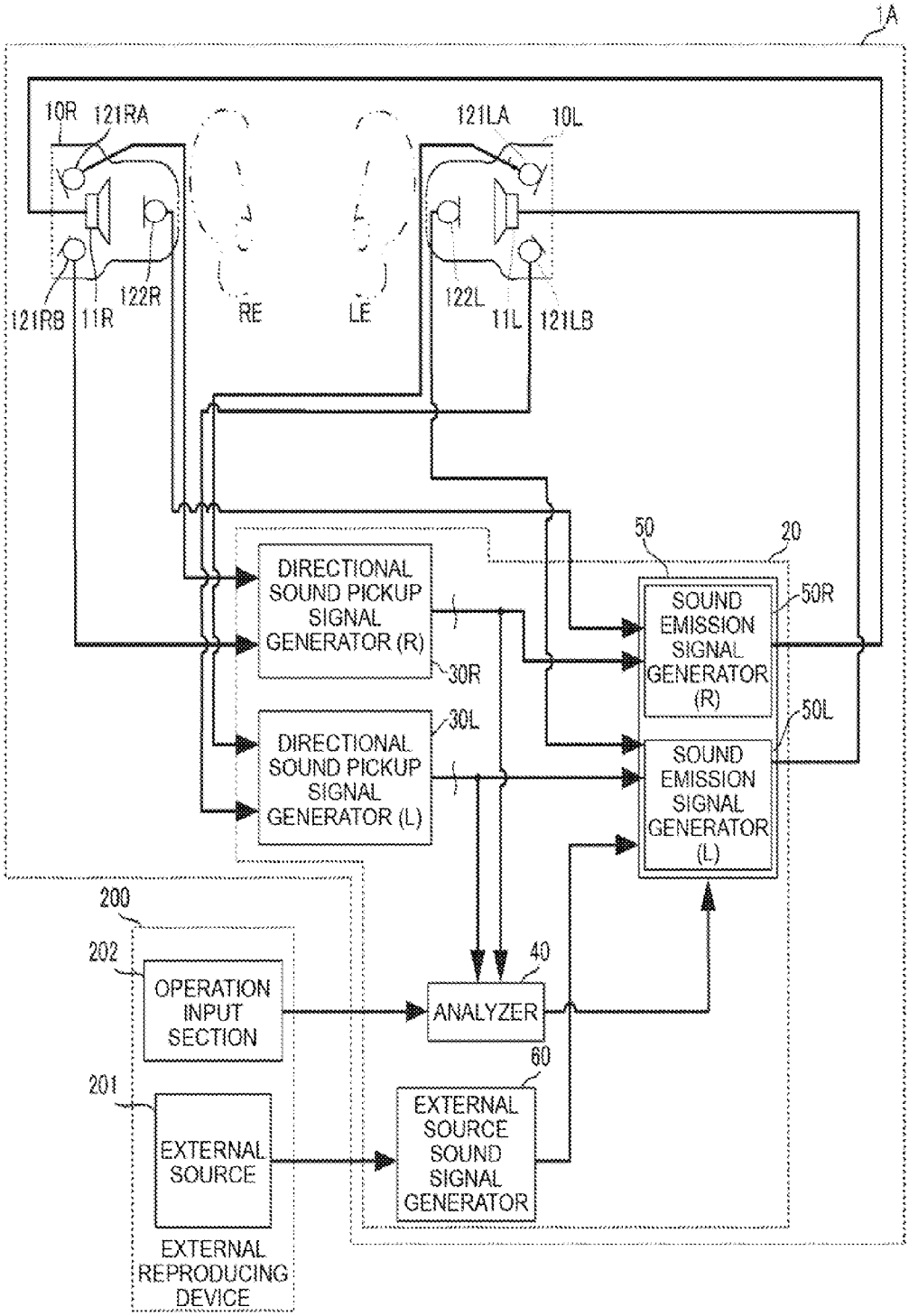
FIG. 1 is a block diagram illustrating a configuration of a headphone according to a first embodiment of the present invention.

A headphone according to a first embodiment of the present invention will be described with reference to the drawings. FIG. 1 is a block diagram illustrating a configuration of a headphone 1A according to the first embodiment of the present invention.

The headphone 1A includes a right ear contact casing 10R, a left ear contact casing 10L and a body 20. The right ear contact casing 10R is used in a state where the right ear contact casing 10R is attached to a right ear RE of a user, and the left ear contact casing 10L is used in a state where the left ear contact casing 10L is attached to a left ear LE of the user. The body 20 is electrically connected to the right ear contact casing 10R and the left ear contact casing 10L. From a structural standpoint, for example, the body 20 may be incorporated into a casing of the headphone 1A in which the right ear contact casing 10R and the left ear contact casing 10L are integral with each other, or the body 20 may be formed separately from the right ear contact casing 10R and the left ear contact casing 10L and connected thereto via a cord.

The right ear contact casing 10R has a structure in which the right ear contact casing 10R is fixed by being attached to the user's right ear RE, and includes external sound pickup microphones 121RA and 121RB, a headphone speaker 11R and a noise cancellation microphone 122R.

The external sound pickup microphones 121RA and 121RB are arranged at a back side of the headphone speaker 11R. The back side corresponds to the opposite side of a sound emission side (front side) of the headphone speaker 11R from which a sound is emitted. Specifically, the external sound pickup microphones 121RA and 121RB are arranged at the back side of the headphone speaker 11R, thus picking up external sounds without picking up no sound emitted from the headphone speaker 11R. For example, the external sound pickup microphones 121RA and 121RB are unidirectional microphones and placed so that respective maximum sound pickup sensitivity directions thereof are not parallel to each other and a given interval is provided therebetween.

The noise cancellation microphone 122R is arranged at the front side of the headphone speaker 11R. The noise cancellation microphone 122R is placed so that its sound pickup direction corresponds to the direction of the speaker 11R.

The external sound pickup microphones 121RA and 121RB pick up external sounds and convert the sounds into electrical signals, thus outputting sound pickup signals Smic0R and Smic1R. The noise cancellation microphone 122R picks up a sound from the speaker 11R and an external sound and converts the sounds into an electrical signal, thus outputting a noise cancellation signal SmicnR. The speaker 11R emits a sound by being driven by a sound emission signal SoutR.

The left ear contact casing 10L has a structure in which the left ear contact casing 10L is fixed by being attached to the user's left ear LE, and includes external sound pickup microphones 121LA and 121LB, a headphone speaker 11L and a noise cancellation microphone 122L.

The external sound pickup microphones 121LA and 121LB are arranged at a back side of the headphone speaker 11L. The back side corresponds to the opposite side of a sound emission side (front side) of the headphone speaker 11L from which a sound is emitted. Specifically, the external sound pickup microphones 121LA and 121LB are arranged at the back side of the headphone speaker 11L, thus picking up external sounds without picking up no sound emitted from the headphone speaker 11L. For example, the external sound pickup microphones 121LA and 121LB are unidirectional microphones and placed so that respective maximum sound pickup sensitivity directions thereof are not parallel to each other and a given interval is provided therebetween.

The noise cancellation microphone 122L is arranged at the front side of the headphone speaker 11L. The noise cancellation microphone 122L is placed so that its sound pickup direction corresponds to the direction of the speaker 11L.

The external sound pickup microphones 121LA and 121LB pick up external sounds and convert the sounds into electrical signals, thus outputting sound pickup signals Smic0L and Smic1L. The noise cancellation microphone 122L picks up a sound from the speaker 11L and an external sound and converts the sounds into an electrical signal, thus outputting a noise cancellation signal SmicnL. The speaker 11L emits a sound by being driven by a sound emission signal SoutL.

The body 20 includes a directional sound pickup signal generator 30R, a directional sound pickup signal generator 30L, an analyzer 40, a sound emission signal generator 50, and an external source sound signal generator 60.

The directional sound pickup signal generator 30R and the directional sound pickup signal generator 30L are configured in the same manner, although the directional sound pickup signal generator 30R performs processing on sound pickup signals for the right ear and the directional sound pickup signal generator 30L performs processing on sound pickup signals for the left ear. Accordingly, only the directional sound pickup signal generator 30R for the right ear will be specifically described below.

Figure 2A:
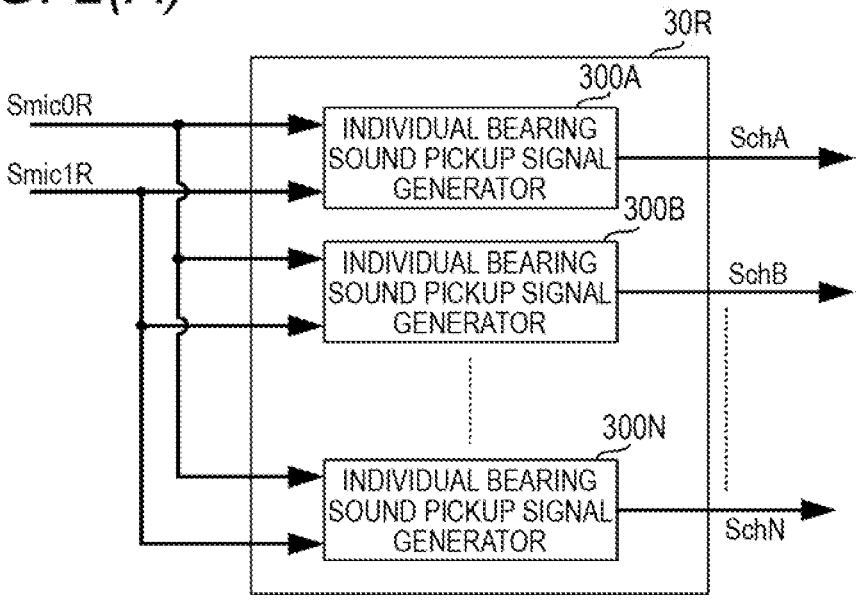
FIGS. 2(A), 2(B) and 2(C) are block diagrams illustrating a configuration of a directional sound pickup signal generator illustrated in FIG. 1.
Figure 2B:
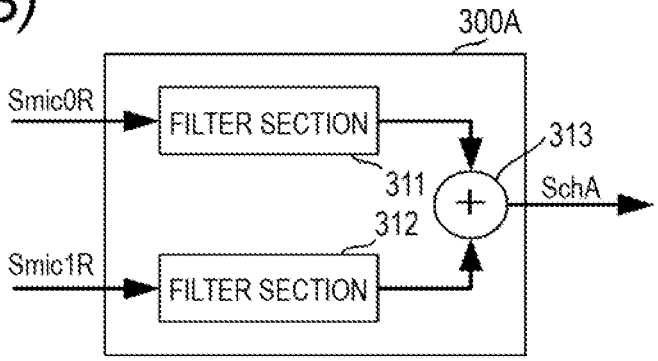
Figure 2C:
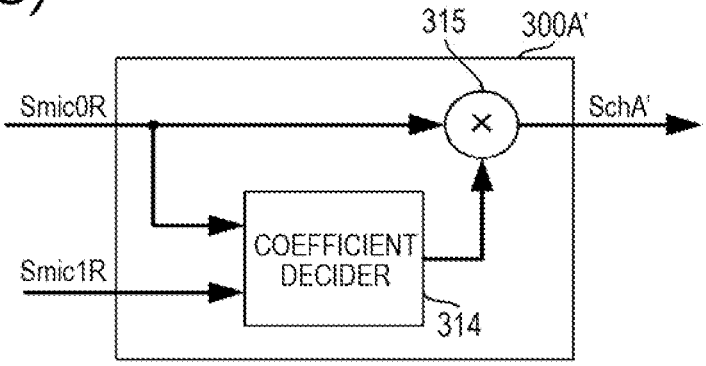

FIGS. 2(A), 2(B) and 2(C) are block diagrams illustrating a configuration of the directional sound pickup signal generator 30R. FIG. 2(A) is a block diagram of the directional sound pickup signal generator 30R, and FIGS. 2(B) and 2(C) are block diagrams of individual bearing sound pickup signal generators 300A and 300A', respectively.

The directional sound pickup signal generator 30R includes the individual bearing sound pickup signal generators 300A to 300N. Note that a case where the directional sound pickup signal generator 30R includes the individual bearing sound pickup signal generators, the number of which corresponds to 300A to 300N, has been described below; however, the number of the individual bearing sound pickup signal generators may be appropriately set in accordance with necessary bearing resolution. More specifically, the number of the individual bearing sound pickup signal generators may be set so that an individual bearing sound pickup signal is generated for each desired angle for bearing resolution in an angular range of 180° corresponding to the right ear in a horizontal plane.

The sound pickup signals Smic0R and Smic1R from the external sound pickup microphones 121RA and 121RB are inputted to each of the individual bearing sound pickup signal generators 300A to 300N.

Based on the sound pickup signals Smic0R and Smic1R, the individual bearing sound pickup signal generators 300A to 300N generate directional sound pickup signals SchA to SchN having directivities at different maximum sound pickup sensitivities.

Specifically, the individual bearing sound pickup signal generators 300A to 300N each have the configuration illustrated in FIG. 2(B) or FIG. 2(C). Note that the individual bearing sound pickup signal generators 300A to 300N are configured in the same manner, although only the formed directivities thereof are different; therefore, the individual bearing sound pickup signal generator 300A will be described by way of example.

(i) When a Process for Adding Up and Combining Sound Pickup Signals is Used

The individual bearing sound pickup signal generator 300A illustrated in FIG. 2(B) includes filter sections 311 and 312, and an adder 313. The filter section 311 performs a given filtering process on the sound pickup signal Smic0R and outputs the resulting signal to the adder 313. The filter section 312 performs a given filtering process on the sound pickup signal Smic1R and outputs the resulting signal to the adder 313. The filter sections 311 and 312 perform gain adjustment or delay adjustment on the sound pickup signals in order to realize desired directivities, for example. The adder 313 adds up the sound pickup signals Smic0R and Smic1R on which the filtering processes have been performed, thus generating the individual bearing sound pickup signal SchA.

(ii) When Processing is Used by Means of a Coefficient that is Based on Sound Pickup Signals The individual bearing sound pickup signal generator 300A' illustrated in FIG. 2(C) includes a coefficient decider 314 and a multiplier 315. Based on the sound pickup signals Smic0R and Smic1R, the coefficient decider 314 decides a coefficient for processing the directivity of the sound pickup signal Smic0R. For example, using the sound pickup signals Smic0R and Smic1R, coefficient deciding signals for different directivities are generated. Then, using a ratio or the like between the coefficient deciding signals, a coefficient by which a high sensitivity is obtained in a range that is steep and narrow in a desired bearing is decided. The multiplier 315 multiplies the sound pickup signal Smic0R by the coefficient, thereby generating an individual bearing sound pickup signal SchA' having a maximum sound pickup sensitivity and a narrow directivity in a desired bearing.

The right individual bearing sound pickup signals SchA to SchN generated by the directional sound pickup signal generator 30R are inputted to the sound emission signal generator 50. Further, the left individual bearing sound pickup signals SchA to SchN, generated by the directional sound pickup signal generator 30L in the same manner as those generated by the directional sound pickup signal generator 30R, are also inputted to the sound emission signal generator 50. Furthermore, the right and left individual bearing sound pickup signals SchA to SchN are also inputted to the analyzer 40.

The analyzer 40 analyzes the right and left individual bearing sound pickup signals SchA to SchN. Specifically, in the analyzer 40, a threshold value for the level of each of the individual bearing sound pickup signals SchA to SchN is set; thus, the analyzer 40 determines the signal as an effective sound when the level is equal to or higher than the threshold value, and determines the signal as a noise when the level is lower than the threshold value. Note that the threshold value is settable by the user. Further, based on the level of each of the individual bearing sound pickup signals SchA to SchN, which has been determined as an effective sound, the analyzer 40 detects a direction in which the effective sound has arrived. Using the determination results and detection results as analysis results, the analyzer 40 generates sound emission control information from the analysis results, and outputs the information to the sound emission signal generator 50.

The sound emission signal generator 50 includes: a sound emission signal generator 50R for the right ear; and a sound emission signal generator 50L for the left ear, and generates the sound emission signals SoutR and SoutL based on the right and left individual bearing sound pickup signals SchA to SchN and the sound emission control information. The sound emission signal generator 50R generates the right sound emission signal SoutR based on the right individual bearing sound pickup signals SchA to SchN and the sound emission control information. The sound emission signal generator 50L generates the left sound emission signal SoutL based on the left individual bearing sound pickup signals SchA to SchN and the sound emission control information.

Note that the sound emission signal generator 50R and the sound emission signal generator 50L have the same block configuration, although the sound emission signal generator 50R performs sound processing for the right ear and the sound emission signal generator 50L performs sound processing for the left ear. Hence, similarly to the description of the foregoing directional sound pickup signal generator, only the right ear sound processing performed by the sound emission signal generator 50R will be specifically described.

Figure 3A:
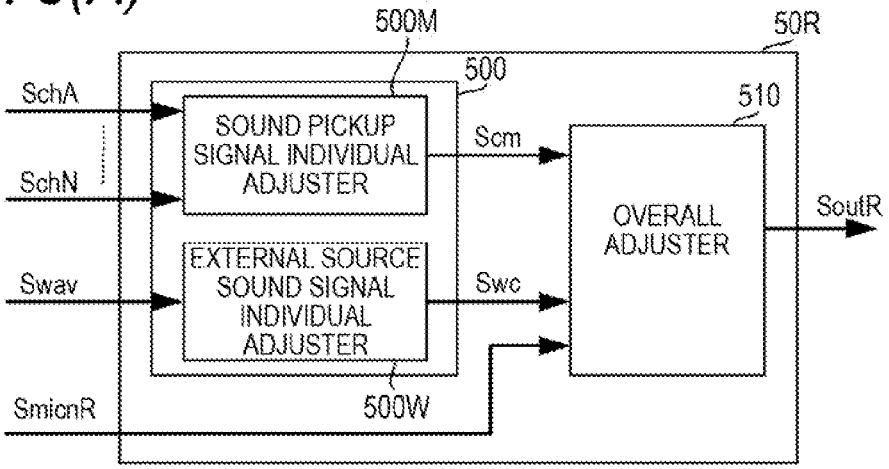
FIGS. 3(A), 3(B) and 3(C) are block diagrams illustrating a configuration of a sound emission signal generator illustrated in FIG. 1.
Figure 3B:
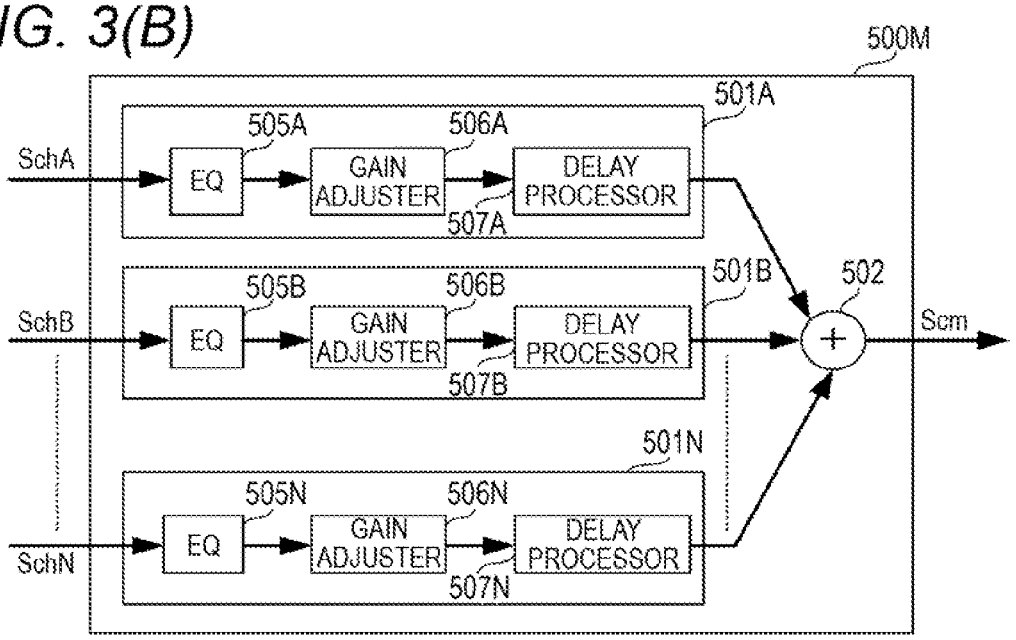
Figure 3C:
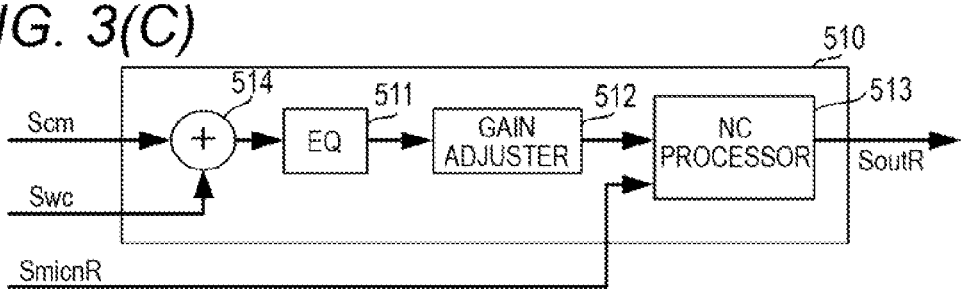

FIGS. 3(A), 3(B) and 3(C) are block diagrams illustrating a configuration of the sound emission signal generator 50R. FIG. 3(A) is a block diagram illustrating the configuration of the sound emission signal generator 50R, FIG. 3(B) is a block diagram illustrating a configuration of a sound pickup signal individual adjuster 500M of an individual adjuster 500 illustrated in FIG. 3(A), and FIG. 3(C) is a block diagram illustrating a configuration of an overall adjuster 510 illustrated in FIG. 3(A).

The sound emission signal generator 50R includes the individual adjuster 500 and the overall adjuster 510. The individual adjuster 500 includes the sound pickup signal individual adjuster 500M and an external source sound signal individual adjuster 500W. The sound pickup signal individual adjuster 500M performs signal adjustment for each of the individual bearing sound pickup signals SchA to SchN. The external source sound signal individual adjuster 500W performs signal adjustment for each channel of an external source sound signal Sway. Only parameters set in the external source sound signal individual adjuster 500W are different from those set in the sound pickup signal individual adjuster 500M, and the external source sound signal individual adjuster 500W has the same configuration as the sound pickup signal individual adjuster 500M. Accordingly, only the sound pickup signal individual adjuster 500M will be described in more detail.

The sound pickup signal individual adjuster 500M includes individual signal processors 501A to 501N and an adder 502. Only parameters set in the individual signal processors 501A to 501N are different, and the individual signal processors 501A to 501N have the same configuration. Each of the individual signal processors 501A to 501N includes an equalizer (EQ), a gain adjuster, and a delay processor. For example, the individual signal processor 501A includes an equalizer 505A (described as "EQ" in the diagram), a gain adjuster 506A and a delay processor 507A. In each of the equalizer 505A, the gain adjuster 506A and the delay processor 507A, a parameter for the individual bearing sound pickup signal SchA is set based on the sound emission control information, and a signal adjustment process is carried out in accordance with the parameter.

The adder 502 adds up the individual bearing sound pickup signals SchA to SchN on which the signal adjustment processes have been performed by the respective individual signal processors 501A to 501N, and thus generates a base sound emission signal Scm. The base sound emission signal Scm is inputted to the overall adjuster 510.

The overall adjuster 510 includes an adder 514, an equalizer 511 (described as "EQ" in the diagram), a gain adjuster 512, and a noise cancellation processor 513. The adder 514 adds up the base sound emission signal Scm and a base source sound signal Swc to combine the signals with each other, and outputs the combined sound emission signal to the equalizer 511. Also in each of the equalizer 511 and the gain adjuster 512, a parameter is set based on the sound emission control information, and a signal adjustment process is carried out on the combined sound emission signal in accordance with the parameter.

The noise cancellation processor 513 (described as "NC PROCESSOR" in the diagram) performs a known noise cancellation process by using: the combined sound emission signal on which equalizer processing and gain adjustment have been performed; and the noise cancellation signal SmicnR provided from the noise cancellation microphone 122R, and thus outputs the sound emission signal SoutR. The sound emission signal SoutR is provided to the headphone speaker 11R of the right ear contact casing 10R, and the resulting sound is emitted to the user's right ear RE from the headphone speaker 11R.

The use of the above-described configuration enables generation of sound emission signals in the following mode.

(Use Mode A)

In a first mode, while a source sound signal is mainly emitted, an effective sound, for example, is emitted in an interrupted manner when necessary.

An external reproducing device 200 includes an operation input section 202 and an external source 201. Upon reception of an operation input for external source reproduction by the operation input section 202, information of the operation input is provided to the analyzer 40. At the same time, music data stored in the external source 201 is read and transmitted to the external source sound signal generator 60.

Upon reception of the operation input for external source reproduction, the analyzer 40 generates sound emission control information indicative of the first mode, and provides the information to the sound emission signal generator 50. Further, as mentioned above, the threshold value for the level of each of the individual bearing sound pickup signals SchA to SchN is set in the analyzer 40; thus, the analyzer 40 detects, as an effective sound signal, the signal having a level equal to or higher than the threshold value, and outputs sound emission control information indicative of existence of the effective sound signal to the sound emission signal generator 50.

The external source sound signal generator 60 outputs an external source sound signal, which is based on the music data, to the sound emission signal generator 50.

Upon reception of the sound emission control information indicative of the first mode, the sound emission signal generator 50 generates, by the external source sound signal individual adjuster 500W, the base source sound signal Swc having sound quality for which an instruction has been provided by the operation input section 202. In this case, when the sound emission control information indicative of existence of an effective sound has not been received, the sound emission signal generator 50 performs, by the sound pickup signal individual adjuster 500M, sound level control so as to suppress the level of the base sound emission signal Scm.

Besides, upon reception of the sound emission control information indicative of existence of an effective sound, the sound emission signal generator 50 generates, by the sound pickup signal individual adjuster 500M, the base sound emission signal Scm that enhances the effective sound. At the same time, upon reception of the sound emission control information indicative of the effective sound, the sound emission signal generator 50 performs, by the external source sound signal individual adjuster 500W, sound level control so as to suppress the level of the base source sound signal Swc.

By performing the above-described processing, only a source sound having sound quality desired by the user is audible to the user while an ambient sound is suppressed in a steady state; on the other hand, only when an effective sound such as a hailing sound is produced, the source sound is suppressed, so that the effective sound is more clearly audible to the user. In this case, the effective sound is set to have a directivity, and therefore, the effective sound is audible to the user in such a manner that the user can also easily perceive a direction in which the effective sound has arrived.

Note that a delay process is performed on the base sound emission signal Scm by the sound pickup signal individual adjuster 500M, thereby making it possible to provide a given time interval between source sound signal suppression timing and effective sound start timing. As a result, the source sound signal and effective signal are more reliably prevented from overlapping each other, and furthermore, the effective sound is easily audible to the user. Moreover, in this case, a speech rate conversion process may also be performed on the base sound emission signal Scm.

Further, in the above description, the control for suppressing the level of the base source sound signal Swc is performed only when the effective sound is detected, and the analyzer 40 decides sound emission control information with reference to the individual bearing sound pickup signals SchA to SchN as described in the foregoing embodiment. In this case, since the individual bearing sound pickup signals SchA to SchN each have directivity information, sound emission control information may be decided based on the directivity information. For example, only an individual bearing sound pickup signal from a bearing inputted in advance by an operation section or the like, or more specifically only an individual bearing sound pickup signal from the rear, may be added to and combined with the base source sound signal Swc. As a result, irrespective of existence or non-existence of an effective sound, the base source sound signal Swc is audible to the user while only a sound from a particular bearing (e.g., from the rear) is included in the base source sound signal Swc at all times.

Figure 4:
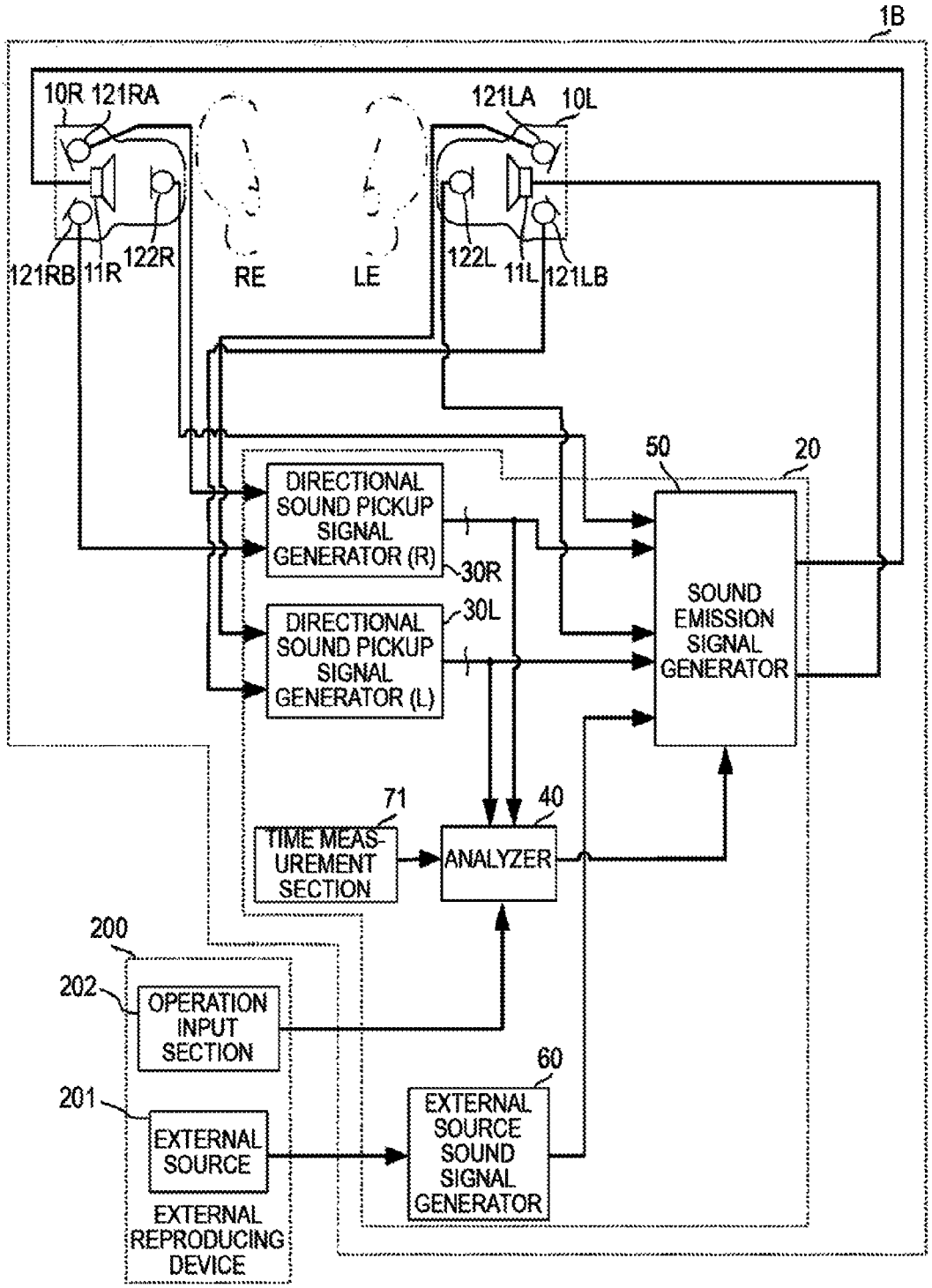
FIG. 4 is a block diagram illustrating a configuration of a headphone according to a second embodiment of the present invention.

Next, a headphone according to a second embodiment will be described with reference to the following diagram. FIG. 4 is a block diagram illustrating a configuration of a headphone 1B according to the second embodiment of the present invention. The headphone 1B according to the present embodiment differs from the headphone 1A described in the first embodiment in that a time measurement section 71 serving as a non-sound information acquirer is provided. Accordingly, only points different from the first embodiment will be specifically described below.

The time measurement section 71 measures time and provides time information to the analyzer 40. The analyzer 40 generates sound emission control information based on the time information, and provides the sound emission control information to the sound emission signal generator 50. Examples of the sound emission control information in this case include information for reducing the sound level and information for increasing the sound level. The sound emission signal generator 50 performs control for reducing or increasing the sound levels (levels) of the sound emission signals SoutR and SoutL in accordance with the sound emission control information.

The use of the above-described configuration enables generation of sound emission signals in the following mode.

(Use Mode B)

An operation input for carrying out a second mode is performed by an unillustrated operation section, and the analyzer 40 receives the operation input; then, the following processing is carried out.

When the second mode is received, the analyzer 40 acquires the time information from the time measurement section 71. The analyzer 40 generates sound emission control information based on: information of operation start time and operation end time set upon reception of a sleep mode, for example; and the time information provided from the time measurement section 71. The sound emission control information includes: level reduction start timing information; level reduction rate information; and sound emission end timing information.

Based on the sound emission control information, the sound emission signal generator 50 performs a process for gradually reducing, at given timing, the level of the combined sound emission signal of the base sound emission signal Scm and the base source sound signal Swc, and for completely suppressing the level after a lapse of a given period of time. As a result, sound emission is enabled in such a manner that the levels of the sound emission signals SoutR and SoutL are gradually reduced. Note that when the level of the base sound emission signal Scm is not the level of an effective sound, the base sound emission signal Scm may be further suppressed, and the level suppression process may be performed only on the base source sound signal Swc. In such a case, the sound emission signal generator 50 may perform the process based on the effective sound determination result provided from the analyzer 40.

When the above-described processing is performed, the source sound and ambient sound gradually become inaudible to the user, thus making it possible to provide a pseudo-sleep state.

Further, contrary to the above-described process for gradually reducing the level of the base sound emission signal Scm, a process for gradually increasing the level of the base sound emission signal Scm may be performed. As a result, the ambient sound becomes audible to the user in such a manner that the ambient sound is gradually increased, thus making it possible to provide a pseudo-waking state.

Furthermore, a filtering processor is added to the sound emission signal generator 50, thus enabling emission of sounds of the sound emission signals SoutR and SoutL which are mainly low frequency band sounds, while gradually reducing the levels thereof. As a result, a more pseudo-sleep state can also be provided.

Moreover, although the example in which only the base sound emission signal Scm is used has been described based on the configuration of the headphone according to the first embodiment in the foregoing description, the configuration of the headphone according to the second embodiment may be applied, and a combined sound signal of the base source sound signal Swc and the base sound emission signal Scm may be used.

Besides, although the example in which sound emission control information is set based only on time information has been described in the foregoing description, an additional process may be performed based on an effective sound detection result. For example, when an effective sound whose level is equal to or higher than a given level is picked up from a given bearing, the effective sound may be emitted in an interrupted manner. In that case, the sound level of the effective sound is preferably gradually increased.

Figure 5:
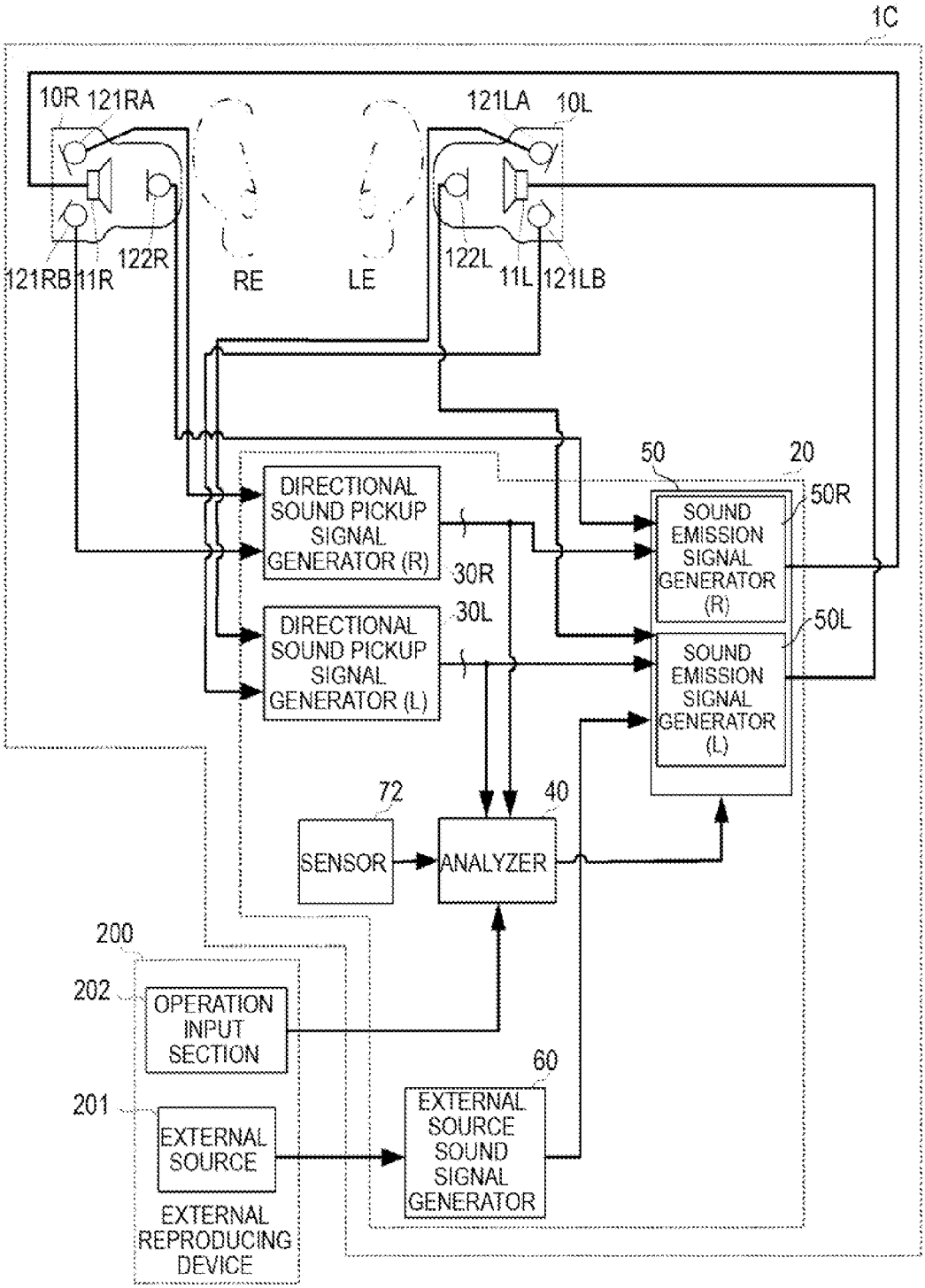
FIG. 5 is a block diagram illustrating a configuration of a headphone according to a third embodiment of the present invention.

Next, a headphone according to a third embodiment will be described with reference to the following diagram. FIG. 5 is a block diagram illustrating a configuration of a headphone 1C according to the third embodiment of the present invention. The headphone 1C according to the present embodiment differs from the headphone 1A described in the first embodiment in that a sensor 72 serving as a non-sound information acquirer is provided. Accordingly, only points different from the first embodiment will be specifically described below.

The sensor 72 senses non-sound information such as positional information or attitude of the headphone 1B, and provides the non-sound information to the analyzer 40. The analyzer 40 generates sound emission control information based on the non-sound information, and provides the sound emission control information to the sound emission signal generator 50. Examples of the sound emission control information in this case include sound processing information and mixing information obtained based on the non-sound information. The sound emission signal generator 50 processes combined sound signals of the base sound emission signals Scm and the base source sound signals Swc in accordance with the sound emission control information, and outputs the sound emission signals SoutR and SoutL. Note that examples of the non-sound information sensed by the sensor 72 also include motion-related information and bearing-related information in addition to the position-related information and information related to the attitude of the headphone 1B.

The use of the above-described configuration enables generation of sound emission signals in the following mode.

(Use Mode C)

An operation input for carrying out a third mode is performed by an unillustrated operation section, and the analyzer 40 receives the operation input; then, the following processing is carried out. The following description will be made using an example in which positional information is used as non-sound information and new sound signals are generated in accordance with the positional information.

When the third mode is received, the analyzer 40 acquires positional information from the sensor 72. Upon acquisition of the positional information, the analyzer 40 acquires sound information associated with the positional information in advance. The sound information may be stored in a memory incorporated into the headphone 1C in advance, or an external communication means may be provided so that the sound information is acquired from outside through information communication. Along with the acquired sound information, sound emission control information, by which the sound information is further combined with the combined sound emission signals of the base sound emission signals Scm and the base source sound signals Swc, is provided to the sound emission signal generator 50 by the analyzer 40.

The sound emission signal generator 50 further combines the sound information with the combined sound emission signals based on the sound emission control information, thus generating and outputting the sound emission signals SoutR and SoutL. As a result, the particular sound emission signals SoutR and SoutL responsive to the position can be provided to the user. In other words, the user can enjoy a sound responsive to a location, or can grasp location-related information by the sound.

Note that a method for combining the base source sound signal Swc with the base sound emission signal Scm may be changed based on the sound emission control information.

Figure 6:
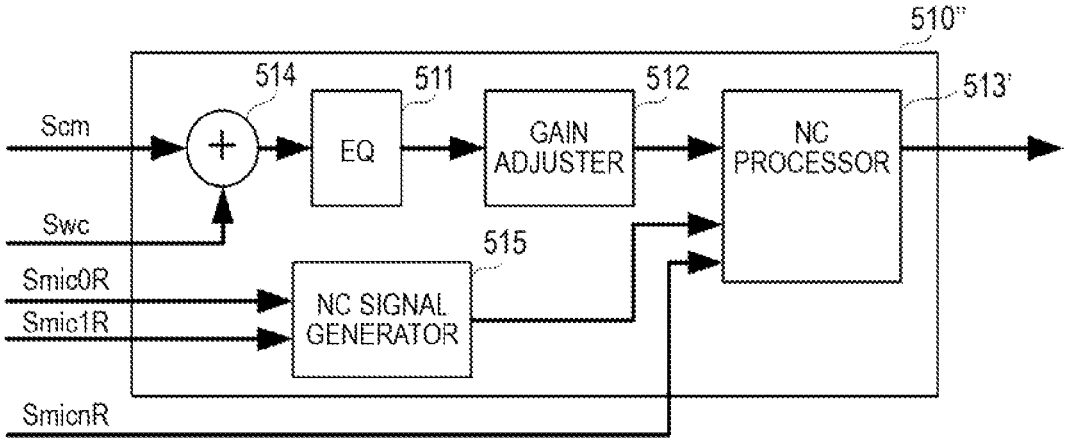
FIG. 6 is a block diagram illustrating a configuration of an overall adjuster in a case where sound pickup signals are used.

In each of the foregoing embodiments, the noise cancellation signals SmicnR and SmicnL provided from the noise cancellation microphones 122R and 122L are used for the noise cancellation process; however, the sound pickup signals Smic0R, Smic1R, Smic0L and Smic1L provided from the external sound pickup microphones 121RA, 121RB, 121LA and 121LB may alternatively be used. FIG. 6 is a block diagram illustrating a configuration of an overall adjuster 510" in a case where the sound pickup signals Smic0R and Smic1R are used. Also in FIG. 6, only a circuit configuration of the overall adjuster 510", corresponding to the right ear, is illustrated similarly to the foregoing description, and the following description will be made on the right ear side circuit configuration. Note that similar configuration and processing may also be applied to a left ear side circuit configuration.

As illustrated in FIG. 6, the overall adjuster 510" in this case further includes a noise cancellation signal generator 515 (described as "NC SIGNAL GENERATOR" in the diagram) in addition to the components of the above-described overall adjuster 510. The noise cancellation signal generator 515 generates a noise cancellation signal by using the sound pickup signals Smic0R and Smic1R. A noise cancellation processor 513' carries out a noise cancellation process by using: the noise cancellation signal that is based on the sound pickup signals Smic0R and Smic1R; and the noise cancellation signal SmicnR.

Also with the use of the above-described method, the noise cancellation process can be reliably carried out.

Note that although the noise cancellation process is invariably performed in the foregoing description, a configuration in which no noise cancellation process is performed depending on a situation may be used.

Furthermore, although the example in which two right external sound pickup microphones and two left external sound pickup microphones are used has been described in the foregoing description, it is only necessary to use a plurality of right external sound pickup microphones and a plurality of left external sound pickup microphones. Moreover, when three or more right external sound pickup microphones and three or more left external sound pickup microphones are three-dimensionally arranged, spatial bearing resolution can be obtained.

According to an aspect of the invention, a plurality of directional sound pickup signals having directivities for a plurality of different bearings are generated from sound pickup signals obtained by a plurality of microphones placed at aback side of a speaker. Further, using an external source sound signal supplied from an external source and the plurality of directional sound pickup signals obtained by the microphones, more various sound emission signals are generated. For example, while an external source sound is emitted, directional sound signals, which are based on the sound pickup signals obtained by the microphones, can be emitted in such a manner that the directional sound signals are appropriately mixed with the external source sound signal in accordance with a situation.

According to an aspect of the invention, in order to produce a sound emission signal, a discrimination is made between an effective sound such as a person's hailing sound or a broadcast sound and a noise (such as a white noise). As a result, a distinction can be made between the effective sound and noise in performing processing, the result of which can be reflected on the sound emission signal.

According to an aspect of the invention, a noise is suppressed and an effective sound is enhanced. As a result, the noise is interrupted and only the effective sound such as a person's hailing sound or a broadcast sound is combined with an external source sound, so that the resulting sound is audible to the user. In this case, since the effective sound is produced in such a manner that the effective sound has a directivity, the effective sound is emitted so as to be heard from the direction in which the effective sound has arrived. Consequently, even while an external source sound is heard in a steady state, upon arrival of an effective sound from outside, the effective sound is audible in such a manner that the user can perceive the direction in which the effective sound has arrived.

According to an aspect of the invention, an external source sound signal is emitted in a steady state, and only when an effective sound exists, the effective sound can be enhanced and emitted while the external source sound signal is suppressed. As a result, for example, even while the user listens to music, a necessary sound from outside is reliably audible in such a manner that the user perceives the direction in which the sound has arrived.

According to an aspect of the invention, the timing of effective sound emission is delayed by a given time relative to that of start of external source sound signal suppression. As a result, it is difficult for an effective sound to be buried in an external source sound, and the effective sound is more clearly audible.

According to an aspect of the invention, sound emission signals are processed by using non-sound information. Examples of the non-sound information include the above-mentioned time and position, and headphone attitude, and also include data information when an external communication function is provided. When sound emission signals are generated based on information other than sound information in this manner, sound emission signals can be generated in more various modes.

According to an aspect of the invention, frequency characteristic processing is performed on sound emission signals, thus making it possible to generate sound emission signals in various modes.

According to an aspect of the invention, a headphone including a microphone is capable of performing, in accordance with a situation, appropriate processing on an external sound picked up by the microphone and a source sound provided from an external source, and capable of emitting a sound from a speaker in various sound emission modes responsive to the situation.

The invention claimed is:

1. A headphone comprising:

a pair of earphone units each including a speaker and a plurality of microphones arranged at a back side of the speaker in a given pattern and through which external sounds are picked up;

a directional sound pickup signal generator configured to generate a plurality of sound pickup signals each having a given directivity, using a plurality of signals output from the plurality of microphones;

an external source sound signal generator through which an external source sound signal from an external source is input; and a sound emission signal generator configured to:

receive a designation of a bearing;

select at least one sound pickup signal from the plurality of sound pickup signals based on the received bearing;

generate an individual bearing sound pickup signal having a directivity corresponding to the received bearing using the selected sound pickup signal;

combine the individual bearing sound pickup signal and the external source sound signal to generate sound emission signals to be input to the speakers of the earphone units.

2. The headphone according to claim 1, further comprising:

an analyzer configured to discriminate between a noise included in the plurality of sound pickup signals and an effective sound, wherein the sound emission signal generator generates the sound emission signals based on a result of the discrimination made by the analyzer.

3. The headphone according to claim 2, wherein the sound emission signal generator suppresses the noise and enhances the effective sound, to generate the sound emission signals.

4. The headphone according to claim 3, wherein, when the effective sound is input, the sound emission signal generator suppresses the external source sound signal and generates sounds that enhance the effective sound using the plurality of sound pickup signals, to generate the sound emission signals.

5. The headphone according to claim 4, wherein the sound emission signal generator outputs the sounds that enhance the effective sound after a given period of time from a timing of suppressing the external source sound signal.

6. The headphone according to claim 2, further comprising:

a time measurement section configured to acquire non-sound information, wherein the sound emission signal generator generates the sound emission signals based on the non-sound information, the effective sound, and the external source sound signal.

7. The headphone according to claim 1, further comprising:

a time measurement section configured to acquire non-sound information, wherein the sound emission signal generator processes the sound emission signals based on the non-sound information.

8. The headphone according to claim 7, wherein the non-sound information includes information related to a time.

9. The headphone according to claim 7, wherein the non-sound information includes information related to a position.

10. The headphone according to claim 1, wherein the sound emission signal generator performs a frequency characteristic processing on the sound emission signals.

* * * * *